US005711219A

United States Patent [19]

Ohno et al.

[11] Patent Number: 5,711,219

[45] Date of Patent: Jan. 27, 1998

[54] RELEASING APPARATUS FOR USE IN TREATING ROLLER OF PRINTING MACHINE

[75] Inventors: Shigehisa Ohno, Nagano; Koichi Kamoi, Tokyo, both of Japan

[73] Assignees: Nagano Japan Radio Co., Ltd., Nagano-ken; Gradco (Japan) Ltd., Tokyo, both of Japan

[21] Appl. No.: 563,767

[22] Filed: Nov. 28, 1995

[30] Foreign Application Priority Data

Feb. 9, 1995 [JP] Japan ..... 7-046517

[51] Int. Cl.[6] ..... B41F 7/02; B41F 7/40; B41F 31/34

[52] U.S. Cl. ..... 101/142; 101/148; 101/352

[58] Field of Search ..... 101/137, 136, 101/139, 140, 141, 142, 143, 144, 145, 247, 148, 351, 352, 249, DIG. 48, 217, 218, 147

[56] References Cited

U.S. PATENT DOCUMENTS

| | | | |
|---|---|---|---|
| 2,306,044 | 12/1942 | Davidson | 101/144 |
| 3,690,251 | 9/1972 | Kagari et al. | 101/142 |
| 5,390,597 | 2/1995 | Hashimoto et al. | 101/142 |

FOREIGN PATENT DOCUMENTS 5-169637 7/1993 Japan .

*Primary Examiner*—J. Reed Fisher

*Attorney, Agent, or Firm*—Birch, Stewart, Kolasch & Birch, LLP

[57] ABSTRACT

Slave rollers 5x, 5y and 5z are attached to a co-axis of a treating roller, and releasing cams 8x, 8y and 8z contacting with the slave rollers 5x, 5y and 5z for separating the treating roller from the plate carrier 2 when a protruding portion protruding above the plate carrier 2 passes through the treating roller, so that the treating roller having contacted with the rotating carrier plate 2 is released from the plate carrier 2.

14 Claims, 6 Drawing Sheets

RELEASING APPARATUS FOR USE IN TREATING ROLLER OF PRINTING MACHINE

BACKGROUND OF THE INVENTION

1. Field of the Invention

The present invention relates to a releasing apparatus for use in a treating roller of a printing machine, for releasing a treating roller contacting a rotating plate carrier.

2. Description of the Relevant Art

Generally, in an offset printing machine, a plate on which an etching treatment is ensured is charged onto a cylindrical printing drum. Humidifying water is spread onto the plate from a liquid supplying apparatus and then ink is spread thereto. At the time of the printing, an ink image is fitted to the plate and is transferred (off) onto a cylindrical blanket drum, then it is printed (set) onto a print sheet.

In a case where there exists a protruding portion of a clamping mechanism clamping the plate, respective treating rollers must be separated from the printing drum. For example, when the same protruding portion passes through respective treating rollers such as a humidifying water spreading roller, an ink spreading roller and a blanket drum, the rollers must be separated.

Up to now, this kind of the releasing apparatus which separates the treating roller from the printing drum, as shown in, for example, the official gazette of Japanese Patent Laying-Open (KOKAI) No. 5(1993)-169637, has adopted a construction in which a roller is supported displaceably by a supporting meaning. The supporting means is displaced selectively from a setting position at which the roller contacts to the printing drum, or from a releasing position at which the roller is separated from the printing drum, by an actuator such as a hydraulic cylinder.

However, there is a problem in the conventional releasing apparatus.

First, it cannot deal with high speed printing, since there exists a delay of the machine response due to the actuator and its mechanical construction, especially in a case where the treating roller is displaced frequently during short time intervals, where a protruding portion of the plate passes through the treating roller.

Secondly, since the treating roller is usually pressure-contacted to the printing drum by a large pressing force, much force is required when displacing the treating roller, so that a large machine producing such force is required which increases the cost of the whole apparatus, such as a case where a large-sized actuator is required.

SUMMARY OF THE INVENTION

It is an object of the present invention, therefore, to provide a releasing apparatus for use in a treating roller of a printing machine, which can treat fully during high speed printing by raising responsiveness of the machine drastically.

Also, it is another object to provide a releasing apparatus for use in a treating roller of a printing machine which can displace easily a treating roller pressure-contacted by a relative large pressing force, while deactivating another actuator in addition to reducing machine size and reducing cost of the whole apparatus.

In order to attain these objects, in the present invention, a releasing apparatus 1 for use in a treating roller of a printing machine has a treating roller contacting a rotating plate carrier 2 which is released from the plate carrier 2. slave rollers 5*x*, 5*y* and 5*z* are attached to a co-axis of (the same axis of) the treating roller, and releasing cams 8*x*, 8*y* and 8*z* contacting slave rollers 5*x*, 5*y* and 5*z*, separate the treating roller from the plate carrier 2 when a protruding portion protruding above the plate carrier 2 passes through the treating roller.

In this case, the treating roller can include a treating liquid spreading roller 3*x* for spreading an etching liquid or a humidifying liquid onto the plate S on the plate carrier 2; an ink spreading roller 3*y* for spreading an ink onto the plate S on the plate carrier 2; and a blanket carrier 3*z* for transferring the ink from the plate S on the plate carrier 2. Also, the protruding portion includes clamping mechanisms 7*a* and 7*b* for clamping the plate S onto the plate carrier 2. The plate carrier 2 comprises an endless plate belt 12 hung on between a pair of pulleys 11*p*, 11*q* spaced from each other, and an endless blanket belt 14 hung on between a pair of pulleys 13*p*, 13*q* spaced from each other. Also, releasing cams 8*x*, 8*y* are attached rotatably to shafts 9*p*, 9*q* of the plate carrier 2, and there is provided a rotating speed reducing mechanism 10 for separating the treating rollers when the protruding portion protruding above the plate carrier 2 passes through the treating roller (treating liquid spreading roller 3*x*, ink spreading roller 3*y* and blanket carrier 3*z*), by reducing a rotating speed of the shaft 9*p* by transmitting the rotational movement to the releasing cams 8*x*, 8*y*. There are provided swingable swing frames 15*x*, 15*y* and 15*z* for supporting the respective rollers 3*x*, 3*y* and the blanket carrier 3*z*, and springs 16*x*, 16*y* for urging the swing frames 15*x*, 15*y* and 15*z* in a direction in which the respective rollers 3*x*, 3*y* and the blanket carrier 3*z* contact to the plate carrier 2. Also, there is provided locking mechanisms 18*x*, 18*y* for fixing positions of the respective rollers 3*x*, 3*y* and the blanket carrier 3*z* spaced from the plate carrier 2. In this case, the locking mechanisms 18*x*, 18*y* have stoppers 19*x*, 19*y* which are displaced to be locked with the swing frames 15*x*, 15*y* and 15*z* spaced from the plate carrier 2.

Thereby, the plate carrier 2 is constituted by an endless plate belt 12 hung on between a pair of pulleys 11*p*, 11*q* spaced from each other, and the blanket carrier 3*z* is constituted by an endless blanket belt 14 hung on between a pair of pulleys 13*p*, 13*q* spaced from each other. Also, at the time of the printing, the treating roller contacts to the plate carrier 2, that is, the treating liquid spreading roller 3*x*, the ink spreading roller 3*y* and the blanket carrier 3*z* contact (pressure-contact) to the plate carrier 2, so that an etching liquid or a humidifying water is spread from the treating liquid spreading roller 3*x* onto the plate S on the plate carrier 2 and also an ink is transferred from the ink spreading roller 3*y* thereto, and the ink is transferred to the blanket carrier 3*z* from the plate S of the plate carrier 2. On this occasion, the respective rollers 3*x*, 3*y* and the blanket carrier 3*z* are supported by the swingable swing frames 15*x*, 15*y* and 15*z*, and urged in a direction of contacting to the plate carrier 2, by the springs 16*x*, 16*y*.

On the other hand, releasing cams 8*x*, 8*y* and 8*z* provided with rotating portions 6*p*, 6*q* of the plate carrier 2 rotate due to the rotation of the plate carrier 2. On this occasion, the rotating portions 6*p*, 6*q* are supported rotatably by shafts of the plate carrier 2, that is, shafts 9*p*, 9*q* of the pulleys 11*p*, 11*q*, and a rotation speed of the shaft 9*p* is reduced and transmitted to the rotating portions 6*p*, 6*q* by a rotation speed reducing mechanism 10. Moreover, the reason why the reduction is thus realized is due to the fact that the plate carrier 2 is constituted by the endless plate belt 12 hung on between a pair of the pulleys 11*p*, 11*q* spaced from each other, so that a rotation period of the pulleys 11*p*, 11*q* becomes longer than a rotation period of the plate belt 12. Then, when the clamping mechanisms 7*a*, 7*b* for clamping the plate S, which are protruding portions protruding above the plate carrier 2, pass through the respective rollers 3*x*, 3*y* and the blanket carrier 3*z*, the releasing cams 8*x*, 8*y* and 8*z* push aside the slave rollers 5*x*, 5*y* and 5*z* rotating together with the respective rollers 3*x*, 3*y* and the blanket carrier 3*z*, and displace the respective rollers 3*x*, 3*y* and the blanket carrier 3*z* to positions spaced apart from the plate carrier 2. Accordingly, the clamping mechanisms 7*a*, 7*b* protruding to the plate carrier 2 pass therethrough without abutting against the respective rollers 3*x*, 3*y* and the blanket carrier 3*z*.

On the other hand, in a case where the respective rollers 3*x*, 3*y* and the blanket carrier 3*z* are not used, the respective rollers 3*x*, 3*y* and the blanket carrier 3*z* are fixed to positions spaced apart from the plate carrier 2 by the locking mechanisms 18*x*, 18*y*. That is, when the respective rollers 3*x*, 3*y* and the blanket carrier 3*z* are separated from the plate carrier 2, the swing frames 15*x*, 15*y* and 15*z* are locked by the displaced stoppers 19*x*, 19*y* . . . , and the swing frames 15*x*, 15*y* and 15*z* are fixed at positions spaced apart from the plate carrier 2.

In the above described manner, since the respective rollers 3*x*, 3*y* and the blanket carrier 3*z* are displaced directly by the releasing cams 8*x*, 8*y* and 8*z* disposed on the plate carrier 2, the responsibility is raised sharply. Also, since a driving force rotating the plate carrier 2 is utilized directly through the releasing cams 8*x*, 8*y* and 8*z*, the respective rollers 3*x*, 3*y* and the blanket carrier 3*z* pressure-contacted by a relatively large pressing force can be displaced easily, and another actuator becomes useless.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An optimum embodiment will be descried hereinafter with reference to the drawings.

At first, an external appearance construction of an offset printing machine M according to this embodiment will be described with reference to FIG. 7.

Figure 7:
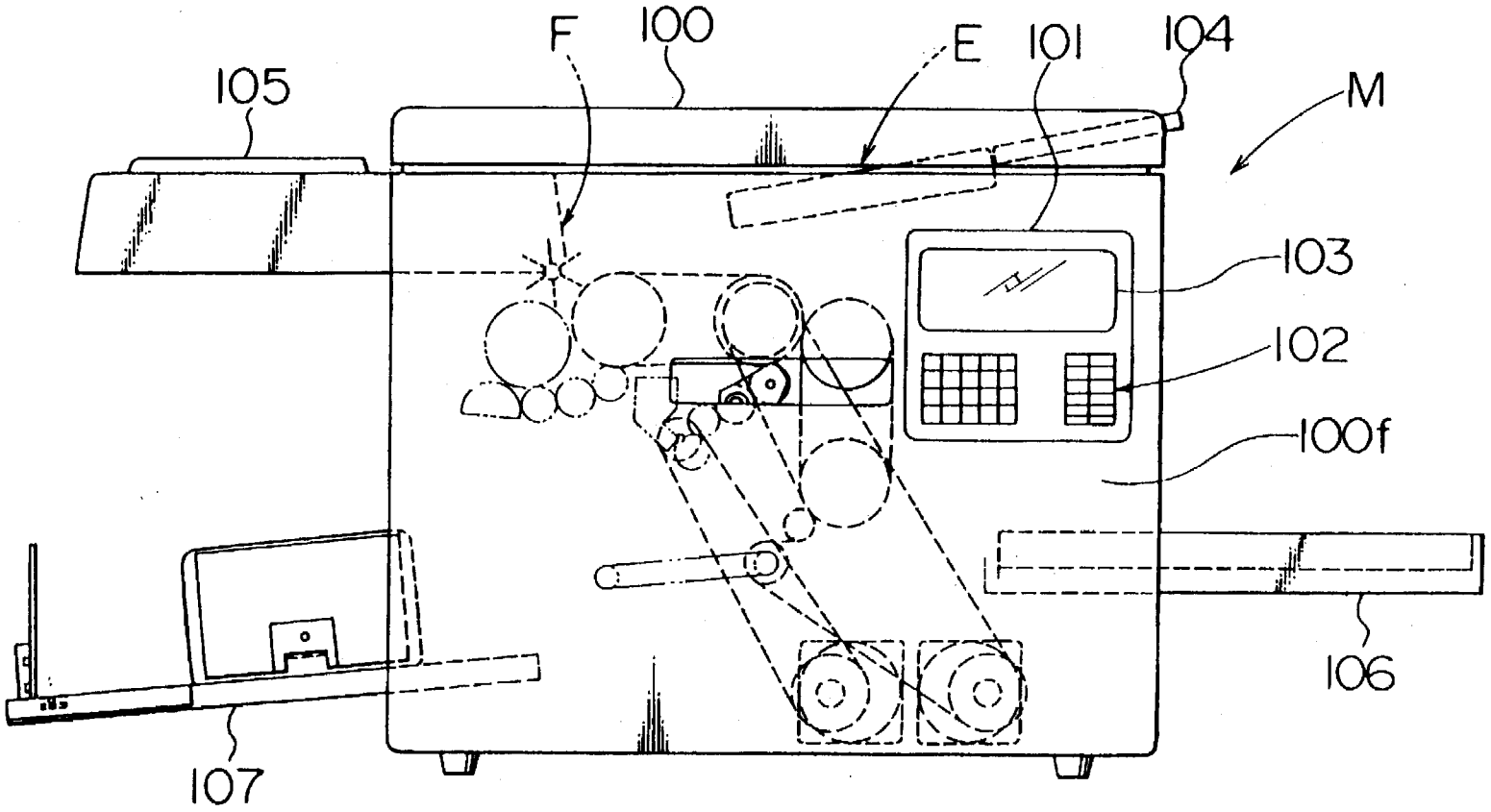
FIG. 7 is an external appearance side view of the same offset printing machine.

In FIG. 7, reference numeral 100 denotes a printing machine, and a case surface 100*f* is provided with an operating panel 101 having an operating key 102 and a display 103. Further, a plate tray 104 of an automatic plate supplying mechanism E for supplying automatically plates S is arranged on an upper rear portion of the printing machine main body 100, and a plate collecting tray 105 of an automatic plate discharging mechanism F for discharging automatically the plates S is arranged on an upper fore portion thereof. Furthermore, a print sheet tray 106 for supplying print sheets is arranged on a lower rear portion of the printing machine main body 100, and a print sheet collecting tray 107 for collecting the print sheets is arranged on a lower fore portion thereof.

Next, an internal construction of an offset printing machine M including a releasing machine 1 according to this embodiment will be described with reference to FIGS. 1 to 6.

Figure 6:
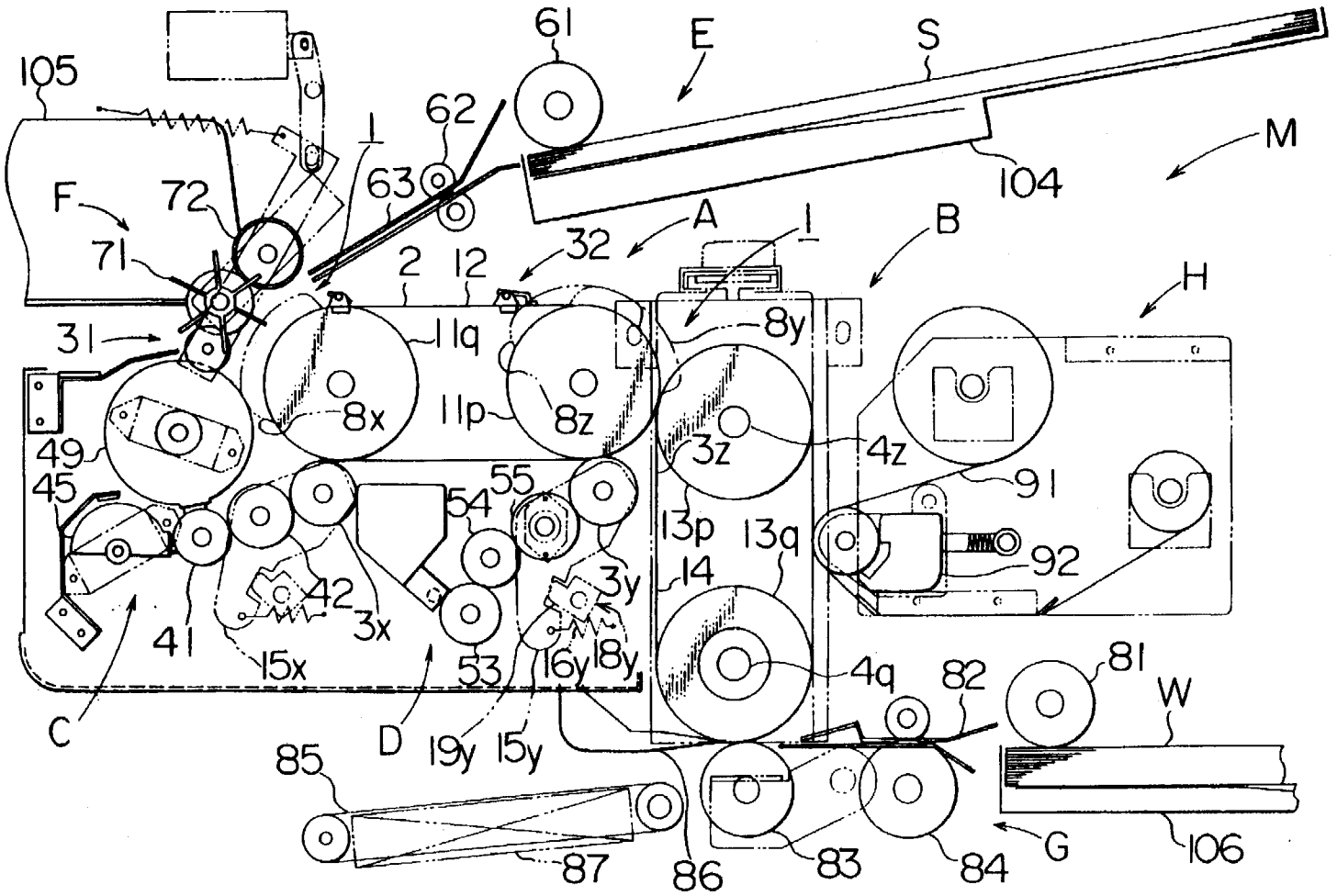
FIG. 6 is an internal constructional view of an offset printing machine provided with the releasing apparatus according to the present invention.

In FIG. 6, symbol A denotes a plate carrier mechanism, which is provided with a pair of pulleys (gears) 11*p*, 11*q* spaced apart from each other in the horizontal direction, and an endless plate belt 12 hung on between the respective pulleys 11*p* and 11*q*, and this plate belt 12 constitutes a plate carrier 2. Incidentally, the plate belt 12 is a timing belt.

Figure 4:
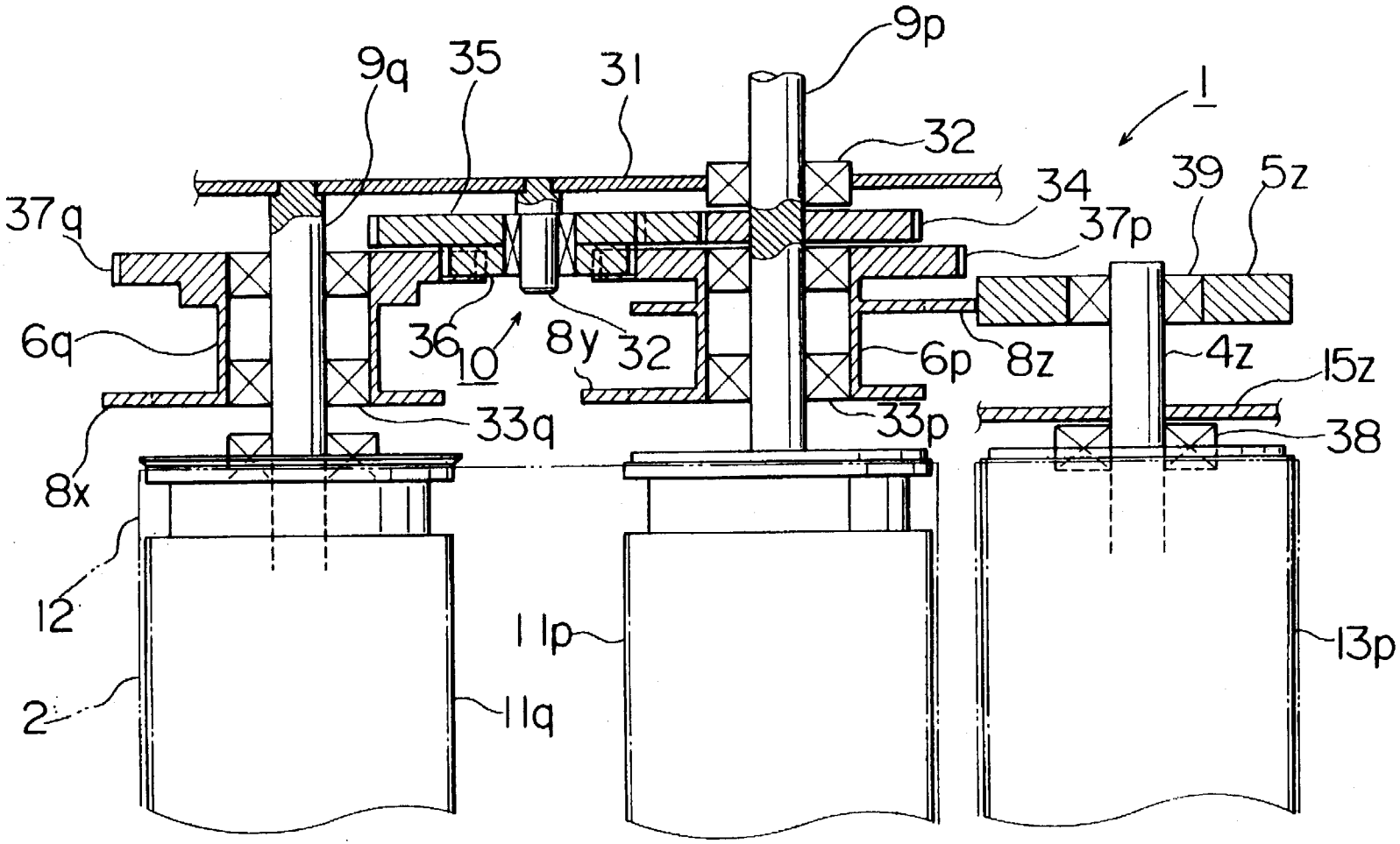
FIG. 4 is a partly sectional constructional plane view of the releasing apparatus according to the present invention.

Then, this plate carrier mechanism A is provided with releasing cams 8*x*, 8*y* and 8*z* constituting the releasing apparatus 1 according to this embodiment. FIG. 4 shows a peripheral construction including the releasing cams 8*x*, 8*y* and 8*z*. In FIG. 4, the pulley 11*p* is provided with a shaft 9*p* which is coaxial, and integral thereto, and both ends of the shaft 9*p* are supported rotatably on a stationary chassis 31 through bearings 32. Moreover, the shaft 9*p* is rotated by a rotating and driving portion (not shown). On the other hand, the pulley 11*q* is supported rotatably on the shaft 9*p*, and both ends of the shaft 9*q* are fixed on the chassis 31.

Figure 1:
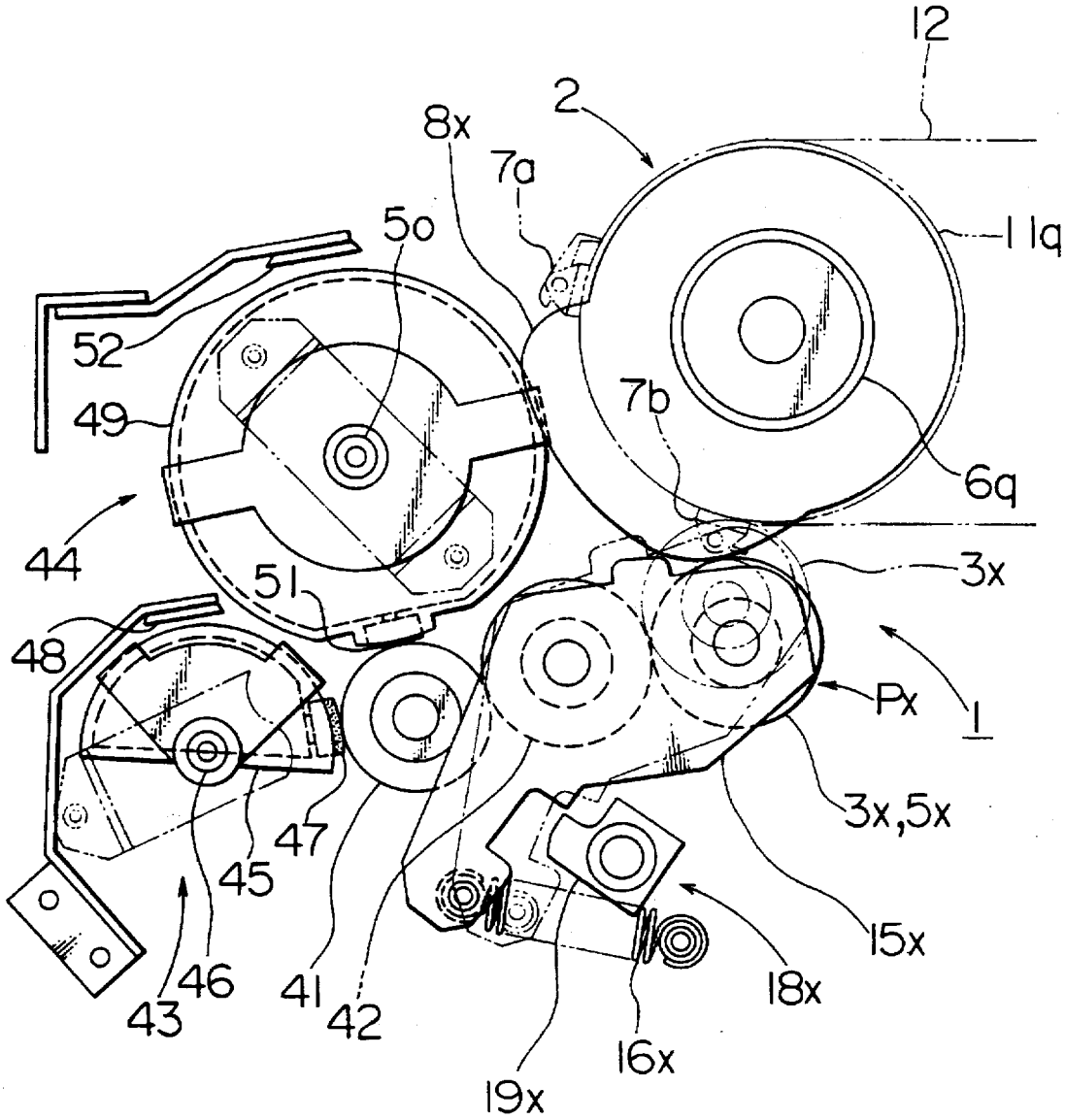
FIG. 1 is a constructional side view of a releasing apparatus according to the present invention, which is provided on a treating liquid spreading roller.
Figure 3:
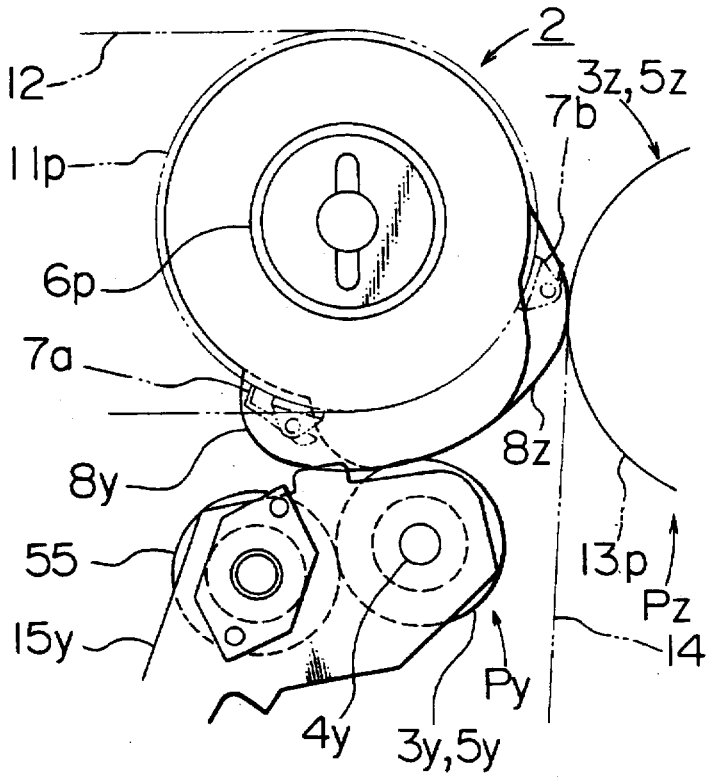
FIG. 3 is a constructional side view of the same releasing apparatus which is provided on an ink spreading roller and a blanket carrier.

Further, the one shaft 9*p* supports rotatably a cylindrical rotating portion 6*p* by a bearing 33*p*, and the other shaft 9*q* supports rotatably a cylindrical portion 6*q* by a bearing 33*q*. Then, the releasing cam 8*y* is attached to one end of the rotating portion 6*p*, the releasing cam 8*z* is attached to an intermediate portion of the rotating portion 6*p*, and the releasing cam 8*x* is attached to one end of the rotating portion 6*q*. Moreover, shapes of the releasing cams 8*x*, 8*y* and 8*z* are shown in FIGS. 1 and 3.

Furthermore, a rotation speed reducing mechanism 10 for reducing a rotating speed of the shaft 9*p* and transmitting it to the rotating portions 6*p*, 6*q* is interposed between the shaft 9*p* and the rotating portions 6*p*, 6*q*. The rotation speed reducing mechanism 10 is provided with a first gear 34 attached to the shaft 9*p*, a second gear 35 supported rotatably on a supporting shaft 32 attached to the chassis 31, a third gear 36 attached coaxially and integrally to this second gear 35, and fourth gears 37*p*, 37*q* attached integrally to the other end of the rotating portions 6*p*, 6*q*, respectively, in which the respective fourth gears 37*p*, 37*q* mesh with the third gear 36. In this embodiment, respective rotation number of the rotating portions 6*p*, 6*q* are set to be ½ of the rotation number of the shaft 9*p*. The reason why is that the plate carrier 2 is constituted by a plate belt 12 hung on between a pair of the pulleys 11*p*, 11*q* spaced apart from each other, and that a rotating period of the plate belt 12 is set to be twice the rotating period of the pulleys 11*p*, 11*q*. Accordingly, in general, if the rotating period of the plate belt 12 is set to be n-times the rotating period of the pulleys 11*p*, 11*q*, respective rotating numbers of the rotating portions 6*p*, 6*q* are set to be 1/n of the rotating number of the shaft 9*p*.

On one hand, on the plate belt 12 are disposed a fore clamping mechanism 7*a* and a rear clamping mechanism 7*b*, and a plate clamping apparatus 32 having an operating mechanism 31 arranged so as to oppose to the plate belt 12. The fore clamping mechanism 7*a* and the rear clamping mechanism 7*b* are referred to as a protrusion portion protruding above the plate belt 12.

Symbol B denotes a blanket carrier mechanism B, which comprises a pair of pulleys (gears) 13*p*, 13*q* spaced apart from in the vertical direction, and an endless blanket belt 14 hung on between the respective pulleys 13*p*, 13*q*, in which the blanket belt 14 constitutes a blanket carrier 3*z*. Moreover, the blanket belt 14 is a timing belt. On this occasion the blanket belt 14 hung on the upper pulley 13*p* is pressure-contacted to the plate belt 12 hung on the pulley 11*q* positioned in a rearward of the plate carrier mechanism A. On this occasion, both ends of a pair of shafts 4*z*, 4*q* spaced apart from each other are fixed to a swing frame 15*z* shown in FIG. 4, and the respective pulleys 13*p*, 13*q* are supported rotatably on a pair of the shafts 4*z*, 4*q* spaced apart from each other through the bearing 38. The swing frame 15*z* can be displaced with the shaft (shaft center) 4*q* as a fulcrum, and is urged by a spring (not shown) in such a direction as that the blanket belt 14 is pressure-contacted to the plate belt 12. Then, a slave roller 5*z* constituting the releasing apparatus 1 according to this embodiment is attached rotatably to the shaft 4 supporting the upper pulley 13*p*, through a bearing 39.

Thereby, as shown in FIGS. 3 and 4, when a peripheral surface of the slave roller 5*z* and a peripheral surface of the releasing cam 8*z* contact to each other, and the clamping mechanisms 7*a*, 7*b* pass through the blanket belt 14 pressure-contacted to the plate belt 12, the releasing cam 8*z* pushes aside the slave roller 5*z*, and displaces the blanket belt 14 to a releasing position Pz spaced apart from the plate belt 12.

Symbol C denotes a treating liquid supplying mechanism, which comprises a first roller 41, a second roller 42 and a treating liquid spreading roller 3*x* contacting in order. In this case, the treating liquid spreading roller 3*x* is supported rotatably on the swing frame 15*x* urged by a spring 16*x*, and pressure-contacted to the plate belt 12. Also, as shown in FIG. 5, since the treating liquid spreading roller 3*x* is supported on the swing frame 15*x* through a shaft 4*x* which is coaxial and integral thereto, the slave roller 5*x* constituting the releasing apparatus 1 according to this embodiment is attached to the shaft 4*x*.

Figure 5:
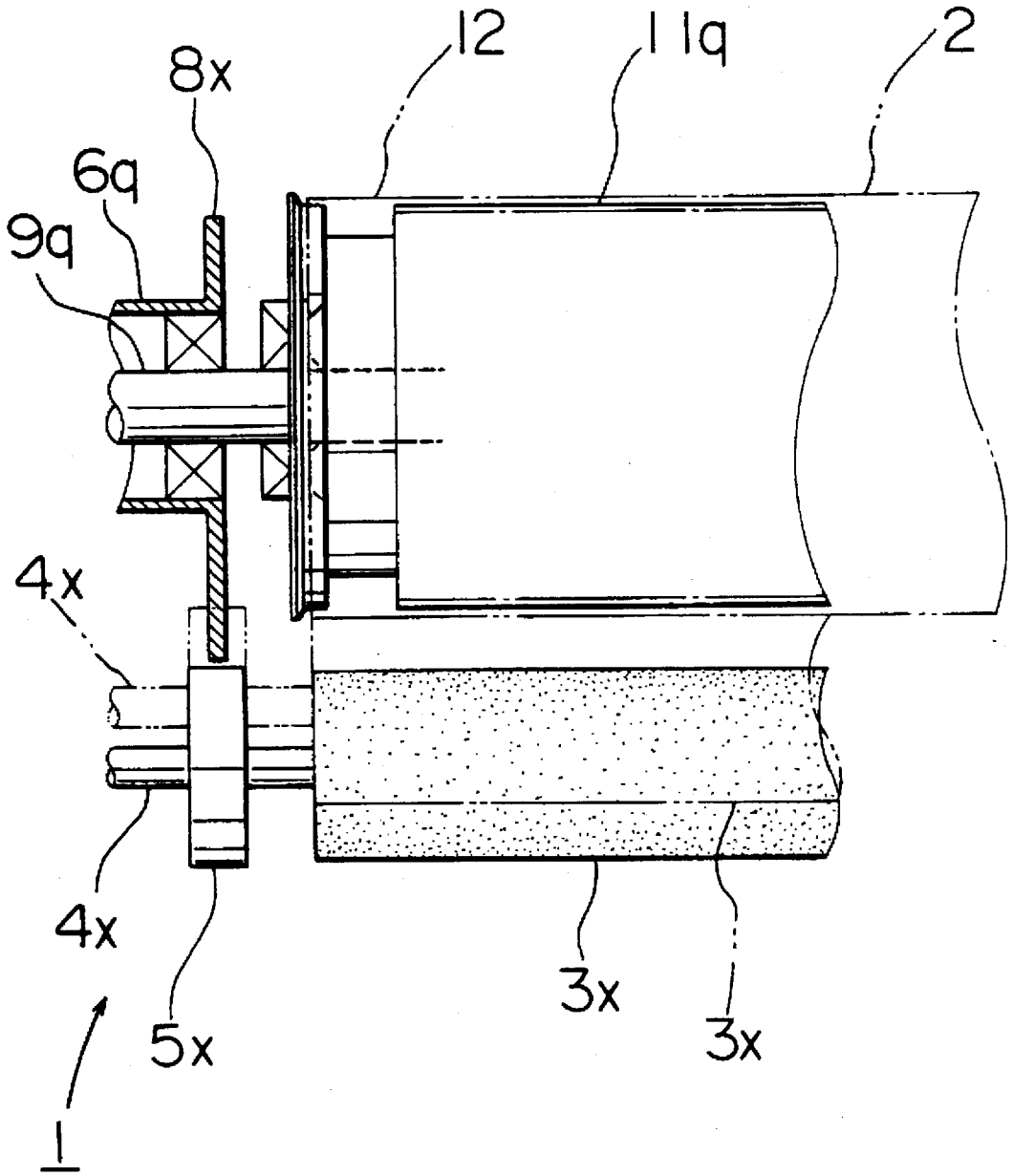
FIG. 5 is a partly sectional constructional front view of the same releasing apparatus.

Thereby, as shown in FIGS. 1 and 5, when a peripheral surface of the slave roller 5*x* and a peripheral surface of the releasing cam 8*x* contact to each other, and the clamping mechanisms 7*a*, 7*b* pass through the treating liquid spreading roller 3*x* pressure-contacted to the plate belt 12, the releasing cam 8*x* pushes aside the slave roller 5*x*, and displaces the treating liquid spreading roller 3*x* to a releasing position Px spaced apart from the plate belt 12.

Figure 2:
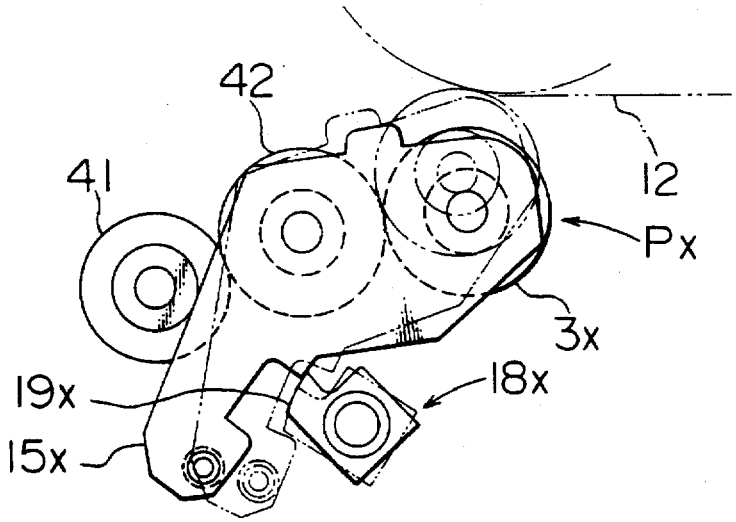
FIG. 2 is a constructional side view of a locking mechanism in the same releasing apparatus, which is in a locking state.

Further, there is provided a locking mechanisms 18*x* which can fix the treating liquid spreading roller 3*x* to the releasing position Px when the treating liquid spreading roller 3*x* is displaced to the releasing position Px. The locking mechanism 18*x* is provided with a stopper 19*x* which can lock the swing frame 15*x* by a rotation-displacement thereof, and as shown in FIG. 2, when the treating liquid spreading roller 3*x* is not used, the stopper 19*x* which is rotation-displaced is locked to the swing frame 15*x* which is displaced to the releasing position Px, thereby fixing the treating liquid spreading roller 3*x* onto the releasing position Px.

Moreover, such a locking mechanism 18*x* is incorporated into the swing frame 15*z* of the aforementioned blanket carrier mechanism B in the same way. Accordingly, when the blanket belt 14 is not used, it is fixed to the releasing position Pz by a locking mechanism.

In the vicinity of the first roller 41 is arranged an etching liquid supplying portion 43 for supplying an etching liquid to the first roller 41 and a humidifying supplying portion 44 for supplying a humidifying water. The etching liquid supplying portion 43 is provided with an etching liquid container 45 containing the etching liquid, and the etching liquid container 45 is rotation-displaced with the supporting shaft 46 as a fulcrum. Thereby, a spreading portion 47 made of felt attached to the etching liquid container 45 is selectively contacted to the first roller 41 or a cap portion 48 which prevents the etching liquid from evaporating. Further, the humidifying supplying portion 44 is provided with a humidifying water container 49 for containing the humidifying water, and is rotation-displaced the supporting shaft 50 to the fulcrum. Thereby, a spreading portion 51 made of felt attached to the humidifying water container 49 is selectively contacted to the first roller 41 or a cap portion 52 which prevents the humidifying water from evaporating. Accordingly, the etching liquid or the humidifying water can be selectively supplied to the first roller 41.

Also, symbol D denotes an ink supplying mechanism, which comprises a first roller 53, a second roller 54, a third roller (laterally swinging roller) 55 as shown in FIG. 6 (FIG. 3), and an ink spreading roller 3*y* contacting with each other in order. On this occasion, the ink spreading roller 3*y* is supported rotatably on the swing frame 15*y* urged by the spring 16*y*, and pressure-contacted to the plate belt 12. Further, as shown in FIG. 3, since the ink spreading roller 3*y* is supported on the swing frame 15*y* through the shaft 4*y* which is coaxial an integral thereto the slave roller 5*y* constituting the releasing apparatus 1 according to this embodiment is attached to the shaft 4*y*. Furthermore, as shown in FIG. 6, there is provided a locking mechanism 18*y* which can fix the ink spreading roller 3*y* at the releasing position Py, when the ink spreading roller 3*y* is displaced to the releasing position Py. The locking mechanism 18*y* is provided with a stopper 19*y* which can lock the swing frames 15*y* by a rotation-displacement thereof.

Thereby, as shown in FIG. 3, a peripheral surface of the slave roller 5*y* and a peripheral surface of the releasing cam 8*y* are contacted to each other, and when the clamping mechanisms 7*a*, 7*b* pass through the ink spreading roller 3*y* pressure-contacted to the plate belt 12, the releasing cam 8*y* pushes aside the slave roller 5*y*, and displaces the ink spreading roller 3*y* to the releasing position Py spaced apart from the plate belt 12. Also, when the ink spreading roller 3*y* is not used, the ink spreading roller 3*y* is fixed to the releasing position Py by the locking mechanism 18*y* similarly to the case of the locking mechanisms 18*x*.

Further, symbol E denotes an automatic plate charging mechanism, which comprises a plate tray 104 for containing a plurality of the plates S, a separating roller 51 for separating and taking out the plates S one by one from the plate tray 104, a plate charging roller mechanism 62 for transferring the plates S taken out from the plate tray 104, and a guiding portion 63 for guiding the plates S, and has a function of supplying automatically the plates S to the plate carrier mechanism A.

On the other hand, symbol F denotes an automatic plate discharging mechanism, which comprises a paddle roller 71 which is displaced in a side of the plate belt 12 to thereby pick up a front portion of the plate S released from the fore clamping mechanisms 7*a* at the time of the discharging, a plate discharging mechanism 72 for transferring and discharging the picked up plate S, and a plate collecting tray 105 for collecting the discharged plate S, and has a function of discharging automatically the plate S from the plate carrier mechanism A.

Furthermore, symbol G denotes a printing mechanism, which comprises a print sheet tray 106 for containing a plurality of print sheets W, a separating roller 81 for separating and taking out the print sheets W one by one from the print sheet tray 106, a guiding portion 82 for guiding the print sheets W taken out from the print sheet tray 106, a pressure-contacting roller 83 which can be pressure-contacted to a surface of the blanket belt 14, a sheet supplying mechanism 84 for sending the print sheets W to between the pressure-contacting roller 83 and the blanket belt 14, and a transferring belt mechanism 85 for sending to a print sheet collecting tray 107 the print sheets W sent from between the pressure-contacting roller 83 and the blanket belt 14. Moreover, reference numeral 86 denotes a tearing off nozzle, and 87 is a suction unit for attracting the print sheets W to the transferring belt mechanism 85.

On the other hand, symbol H demotes a cleaning mechanism H, which removes a residue ink on the blanket belt 14 by a cleaning sheet 91 of a cloth, etc. supplied from a roll and a cleaning liquid supplied from a cleaning liquid supplying portion 92.

Next, a whole operation of the offset printing machine M having the releasing apparatus 1 according to this embodiment will be described with reference to the respective drawings.

First, the plates S, are set on the plate tray 104. On this occasion, the print sheet on which a toner is printed by a laser printer can be used for the plate S. On the other hand, the plates S set onto the plate tray 104 are charged automatically onto the surface of the plate belt 12 by the automatic plate supplying mechanism E. That is, at the time of the charging, after the fore portion of the plate S is clamped by the fore clamping mechanisms 7*a*, the plate S is charged onto the plate belt 12 and a rear portion of the plate S is clamped by the rear clamping mechanisms 7*b*.

Further, at the time of the charging of the plates S, simultaneously the etching treatment is carried out. On this occasion, an ink spreading roller 3*g* of an ink supplying mechanism D is fixed to the releasing position Py and a blanket belt 14 are fixed to the releasing position Pz, respectively. On the other hand, treating liquid spreading roller 63 of the treating liquid supplying mechanism C are pressure-contacted to the plate belt 2, and then the etching liquid supplied from an etching supplying portion 43 is spread to the plate belt 12. Thereby, a contamination and dusts, etc. of the plates S are removed, then hydrophilic property is raised.

On one hand, in the printing step, the ink spreading roller 3*y* of the ink supplying mechanism D, the blanket belt 14, and the treating liquid spreading roller 3*x* of the treating liquid supplying mechanism C are pressure-contacted to the plate belt 12, respectively. Further, the humidifying supplying portion 44 is set so as to supply the humidifying water to the plate belt 12. Thereby, if the plate S is advanced from a stand-by position, the humidifying water is spread to the plate S charged onto the plate belt 12, further, the ink is spread from the ink supplying mechanism D. On this occasion, the ink is fitted only to the image portion of the plate S. Then, the ink image on the plate S is transferred to the surface of the blanket belt 14. On the other hand, in the printing mechanism G, the print sheets W are automatically fed to between the blanket belt 14 and the pressure-contacting roller 83, and the ink image of the blanket belt 14 is printed the humidifying supplying portion 44 onto the print sheet W.

In this case, the plate belt 12 is rotation-moved by the rotation of the shaft 9*p*, and the rotation of the shaft 9*p* is reduced by the rotation speed reducing mechanism 10 to be transmitted to the rotating portions 6*p*, 6*q*. Then, when the clamping mechanisms 7*a*, 7*b* pass through the treating liquid spreading roller 3*x*, the ink spreading roller 3*y* and the blanket belt 14, the releasing cams 8*x*, 8*y* and 8*z* push aside the slave rollers 5*x*, 5*y*, and 5*z* disposed in a side of the rollers 3*x*, 3*y*, and displace the rollers 3*x*, 3*y* and the blanket belt 14 to the releasing positions Px, Py, and Pz. Accordingly, the clamping mechanisms 7*a*, 7*b* protruding to the plate belt 12 pass therethrough without abutting against the rollers 3*x*, 3*y* and the blanket belt 14. Incidentally, such a printing step is repeated by the number of the print sheets.

Also, the plate S charged to the plate belt 12 is discharged by the automatic plate discharging mechanism F and collected to the plate collecting tray 105 when the printing of the plate S is finished. On the other hand, the residue ink of the blanket belt 14 is removed by the cleaning mechanism H.

As described above, the embodiment has been described in detail, however, the present invention is not limited to such an embodiment. For example, the plate carrier is exemplified as the endless plate belt hung on between a pair of pulleys spaced apart from each other, however, a cylindrical printing drum can be applied thereto similarly. In this case, the rotation speed reducing mechanism becomes useless. Also, a cylindrical blanket drum can be used for the blanket carrier. Otherwise, in detail construction, shape, number, material and the like, it may be charged on occasion without departing from the spirit and the scope of the present invention.

We claim:

1. A releasing apparatus of a printing machine comprising:

a rotating plate carrier including an endless belt hung between a first pulley and a second pulley, said first pulley being mounted on a first shaft, said second pulley being mounted on a second shaft, a plurality of clamping mechanisms protruding from said plate carrier, each clamping mechanism supporting a plate on said plate carrier;

a plurality of releasing cams mounted on said plate carrier, said first shaft and said second shaft having at least one releasing cam attached thereto coaxially with each pulley;

a treating roller and a slave roller being mounted on a third shaft, said treating roller contacting said plate carrier when said cams are in a first predetermined position and said treating roller being spaced apart from said plate carrier when said cams are in a second predetermined position where said cams contact said slave roller, whereby translational movement velocity of said treating roller and mechanical efficiency of said printing machine are substantially increased while said clamping mechanisms protruding from said plate carrier pass through said printing machine without substantial interference from said treating roller.

2. The releasing apparatus of claim 1, further comprising:

a plurality of gears mounted in said plate carrier, said first shaft and said second shaft having at least one gear attached thereto coaxially with each pulley and each cam;

and a rotation speed reducing mechanism including a shaft and a gear mounted on said shaft, said gear contacting with at least one gear of said first shaft and said second shaft.

3. The releasing apparatus of claim 2, wherein said second shaft includes two cams and two gears in coaxial alignment, said rotation speed reducing mechanism includes a gear with first diameter and a gear with a second diameter, said first diameter is smaller than said second diameter, said first diameter gear contacts with one gear of said first shaft and one of two said gears of said second shaft, and said second diameter gear contacts with another gear of said two gears of said second shaft.

4. The releasing apparatus of claim 2, wherein said first shaft, said second shaft, and said rotation speed reducing mechanism shaft are mounted to a chassis.

5. The releasing apparatus of claim 3, wherein a gear of said two gears and said two cams of said second shaft are connected to a cylinder, said cylinder is rotatably mounted to said second shaft by a bearing device.

6. The releasing apparatus of claim 5, further comprising a fourth shaft, one of two said cams of said second shaft in said second predetermined position contacts a blanket carrier treating roller mounted on said third shaft, and another of said two cams of said second shaft in said second predetermined position contacts an ink spreading treating roller mounted on said fourth shaft.

7. The releasing apparatus of claim 3, wherein said first shaft includes a gear and a cam connected to a cylinder, said cylinder is rotatably mounted to said first shaft by a bearing device.

8. The releasing apparatus of claim 1, wherein said treating roller contacts a treating liquid, said liquid is at least one of an etching liquid and a humidifying liquid.

9. The releasing apparatus of claim 1, wherein said treating roller includes a blanket carrier, said blanket carrier transferring ink from a plate to said plate carrier.

10. The releasing apparatus of claim 9, wherein said blanket carrier includes an endless belt hung on a pair of pulleys spaced apart relative to each other.

11. The releasing apparatus of claim 1, wherein said treating roller contacts ink, said treating roller spreading ink onto a plate on said plate carrier.

12. The releasing apparatus of claim 1, wherein said third shaft of said treating roller is supported by a swing frame, said swing frame pivots in accordance with said first and second predetermined positions of said cams, said swing frame further includes a locking mechanism and a spring device biasing said swing frame, and said locking mechanism is provided with a stopper which locks said swing frame when said cams are in said second predetermined position.

13. The releasing apparatus of claim 12, wherein said swing frame further includes another roller rotatably supported by said swing frame, and said roller contacting said treating roller.

14. The releasing apparatus of claim 1, wherein said clamping mechanisms are positioned on said plate carrier at predetermined positions which are adjacent and aligned with protruding portions of said cams.

* * * * *